US005732493A

United States Patent [19]

Luedtke et al.

[11] Patent Number: 5,732,493

[45] Date of Patent: Mar. 31, 1998

[54] DUAL PENDULUM DISPLAY APPARATUS

[75] Inventors: Eugene R. Luedtke; Gregory J. Adelman, both of Reedsburg; Duane C. Gerke, North Freedom; David L. Vergara, Reedsburg; Donald R. Fish, Reedsburg; Steven J. Ellingson, Reedsburg; Joseph W. Fish, Reedsburg; Yi Yale Zhang, Janesville, all of Wis.

[73] Assignee: Hankscraft Motors, Inc., Reedsburg, Wis.

[21] Appl. No.: 528,190

[22] Filed: Sep. 14, 1995

[51] Int. Cl.[6] ..... G09F 19/00

[52] U.S. Cl. ..... 40/485; 40/411; 40/414; 74/48

[58] Field of Search ..... 40/411, 414, 430, 40/485, 492; 446/325, 326, 396; 74/48

[56] References Cited

U.S. PATENT DOCUMENTS

| | | | |
|---|---|---|---|
| 957,352 | 5/1910 | Liles | 40/411 |
| 1,280,508 | 10/1918 | McHenry | 40/485 X |
| 1,685,358 | 9/1928 | Harcourt | 40/411 X |
| 1,845,137 | 2/1932 | Disser, Sr. | 40/485 |
| 2,129,585 | 9/1938 | Locke | 40/411 |
| 2,162,065 | 6/1939 | Dallinger | 40/411 |
| 3,022,594 | 2/1962 | Wendell | 40/485 X |
| 4,341,035 | 7/1982 | Jaworski et al. | 46/135 R |
| 4,422,530 | 12/1983 | Denton | 40/485 X |
| 4,869,703 | 9/1989 | Ong | 40/414 X |
| 5,285,739 | 2/1994 | Huang | 74/48 X |
| 5,377,433 | 1/1995 | Hazelhurst | 40/411 |
| 5,393,259 | 2/1995 | Lee | 40/414 X |
| 5,462,471 | 10/1995 | Power-Fardy | 40/414 X |

*Primary Examiner*—Blair Johnson
*Assistant Examiner*—Andrea Chop
*Attorney, Agent, or Firm*—Michael, Best & Friedrich

[57] ABSTRACT

A dual pendulum display apparatus comprising a housing, a motor which is fixed to the housing and which has an output shaft, an output gear which is driven by the output shaft, which is mounted on the housing for rotation relative thereto about an output gear axis, and which has thereon a projection spaced from the output gear axis, a pivot arm mounted on the housing for pivotal movement relative thereto about a pivot arm axis spaced from the output gear axis, the pivot arm having therein a longitudinal slot receiving the projection for reciprocal sliding movement of the projection in the slot, such that rotation of the output gear and movement of the projection in the slot causes pendulum type motion of the pivot arm, the pivot arm having opposite first and second ends spaced from the pivot arm axis, first advertising material mounted on the first end of the pivotal arm, and second advertising material mounted on the second end of the pivot arm, such that the first advertising material and the second advertising material move back and forth in opposite directions in response to pendulum type movement of the pivot arm.

15 Claims, 6 Drawing Sheets

DUAL PENDULUM DISPLAY APPARATUS

BACKGROUND OF THE INVENTION

1. Field of the Invention

The invention relates to an apparatus for the display of advertising indicia, such as in point-of-purchase displays in retail stores.

2. Discussion of Prior Art

Various devices are known for the display of advertising materials or indicia in point-of-purchase displays. Pendulum-type displays are also known.

SUMMARY OF THE INVENTION

The invention provides a pendulum display apparatus which is a compact, lightweight, self-contained, self-aligning unit of inexpensive construction. The display apparatus provides simultaneous, pendulum-type motion of one or more pieces of advertising material. In one embodiment, the display apparatus also provides static display of another piece of advertising material.

The invention provides a display apparatus which can be supported or mounted by a variety of methods, including cup washers, suction cups, slotted walls, peg boards, etc., and which can be mounted in different orientations.

The invention provides a display apparatus which is easily assembled for use and which is easily changed to display different advertising material.

The invention also provides a simple and inexpensive method for manufacturing a pendulum-type advertising display. A housing is injection molded with a simple two-piece die having no moveable cores. The housing is molded with an integral seat and integral snap-in retainers for a motor, and with integral mounting posts for all rotating or pivoting parts. Thus, the position of the motor and the axes of all pivoting and rotating parts are fixed during the injection molding process, allowing tight control of tolerances. The motor and the moving parts are then easily mounted on the housing. The housing is preferably also molded with a battery space.

Other features and advantages of the invention will become apparent to those skilled in the art upon review of the following detailed description, claims and drawings.

Figure 1:
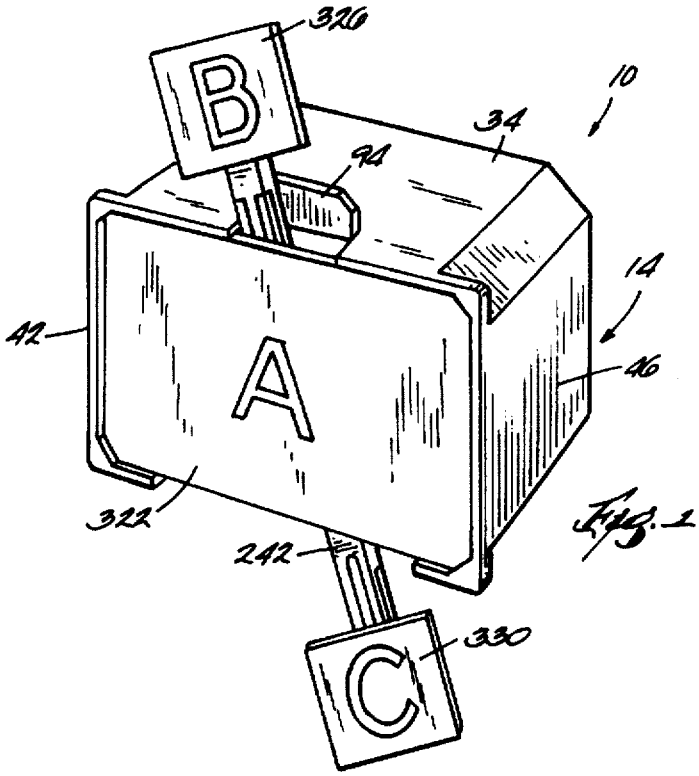
FIG. 1 is a perspective view of a display apparatus embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT

Figure 9:
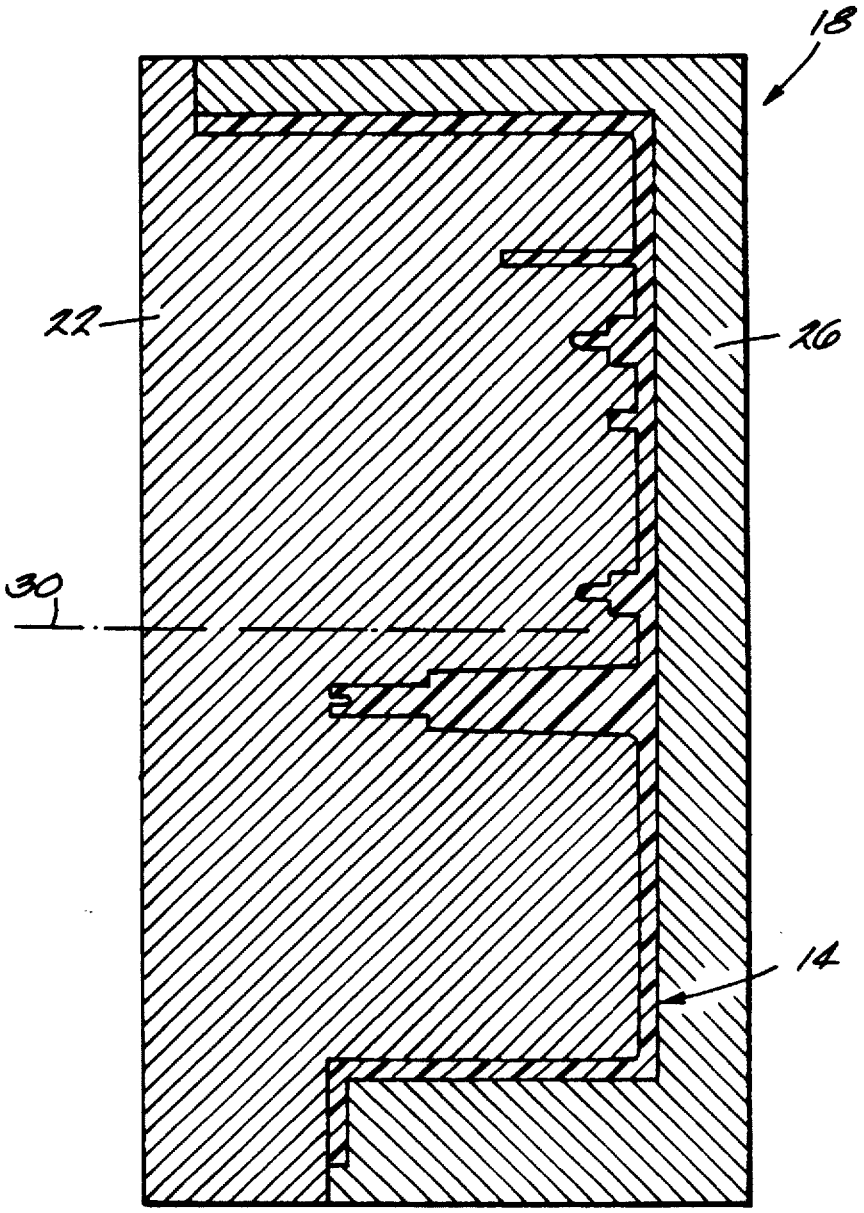
FIG. 9 is a sectional view of a die used to mold the housing of the apparatus.

A dual pendulum advertising display or point-of-purchase display 10 embodying the invention is illustrated in the drawings. The display 10 comprises a housing 14 which is preferably made of injection molded plastic. The method of molding the housing 14 is partially illustrated in FIG. 9. The housing 14 is injection molded with a die 18 having only two parts 22 and 26 movable relative to each other along an axis 30. The die 18 has no movable cores so that the injection molding process is relatively inexpensive. The housing 14 is molded in a single step, i.e. with a single injection, so that all of the below described parts of the housing 14 are integral or form a single structure.

Figure 3:
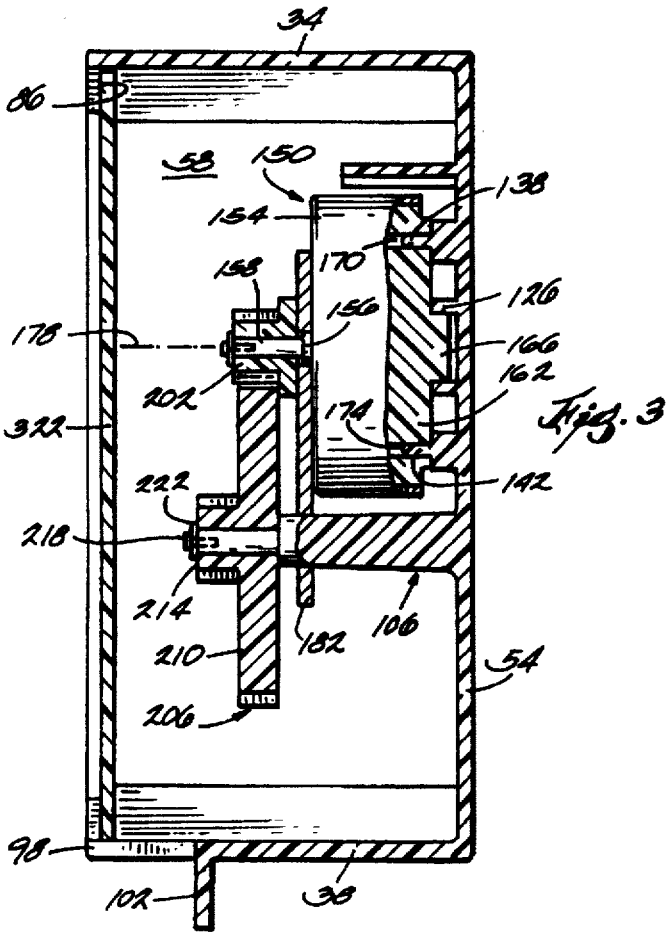
FIG. 3 is a view taken along line 3—3 in FIG. 2.
Figure 2:
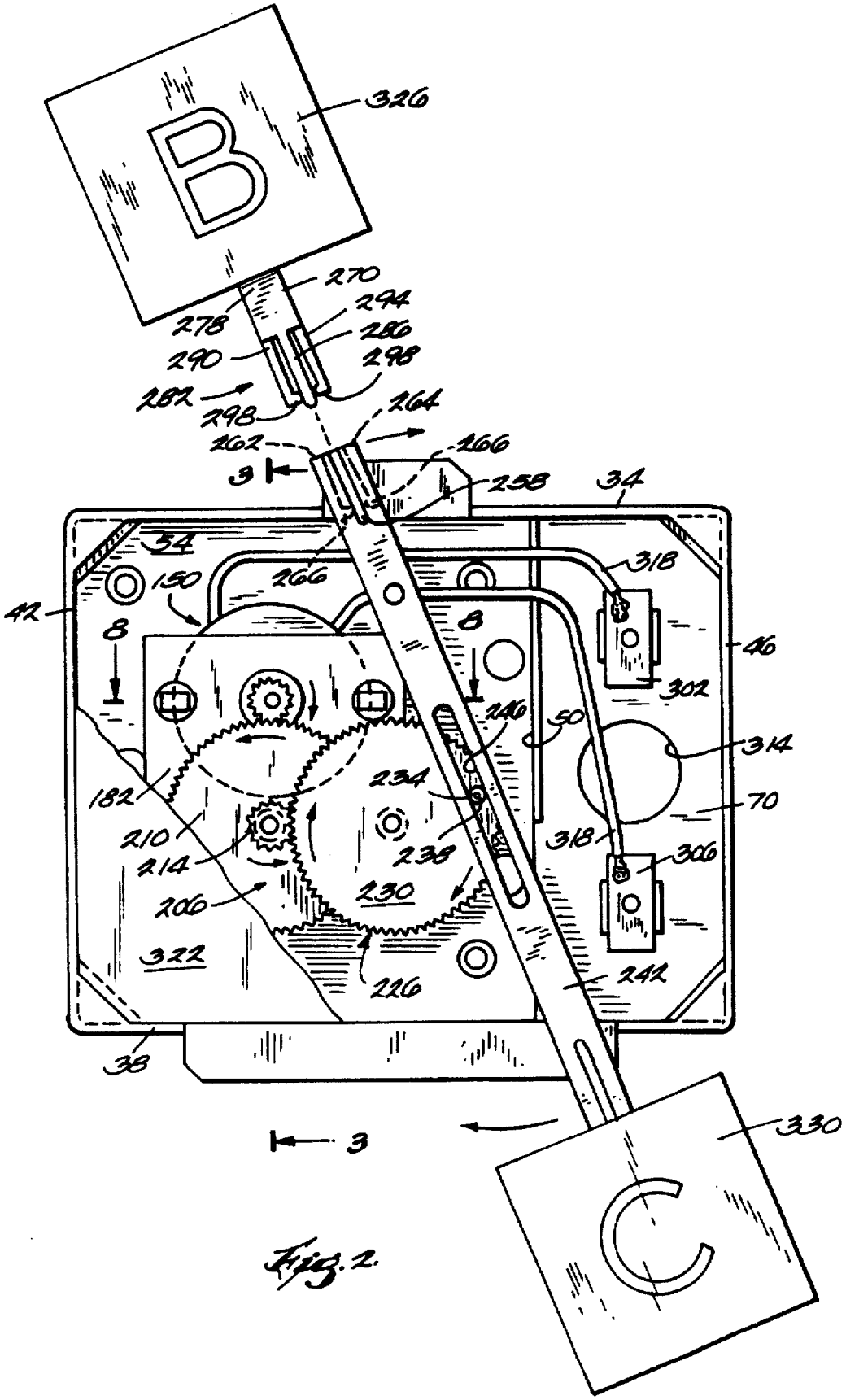
FIG. 2 is a front elevational view, partially broken away, of the apparatus.

The housing 14 is a generally rectangular box having spaced, parallel top and bottom walls 34 and 38 and spaced, parallel end walls 42 and 46 perpendicular to the top and bottom walls 34 and 38. A partition wall 50 (see FIGS. 2 and 6) extends between the top and bottom walls 34 and 38 in spaced, parallel relation to the end wall 46. A back wall 54 (see FIGS. 3 and 6) extends between the top and bottom walls 34 and 38 and between the end wall 42 and the partition wall 50 and defines the back of a main space or chamber 58 (see FIG. 3). Upper and lower battery space walls 62 and 66 (see FIG. 6) extend between the partition wall 50 and the end wall 46 in spaced, parallel relation to the top and bottom walls 34 and 38, respectively. A front battery space wall 70 (see FIG. 2) extends between the partition wall 50 and the end wall 46 and between the upper and lower battery space walls 62 and 66. The front battery space wall 70 is parallel to and spaced forwardly from the back wall 54 so that the front battery space wall 70 defines the front of a rearwardly opening battery space 74 (see FIG. 6).

Figure 4:
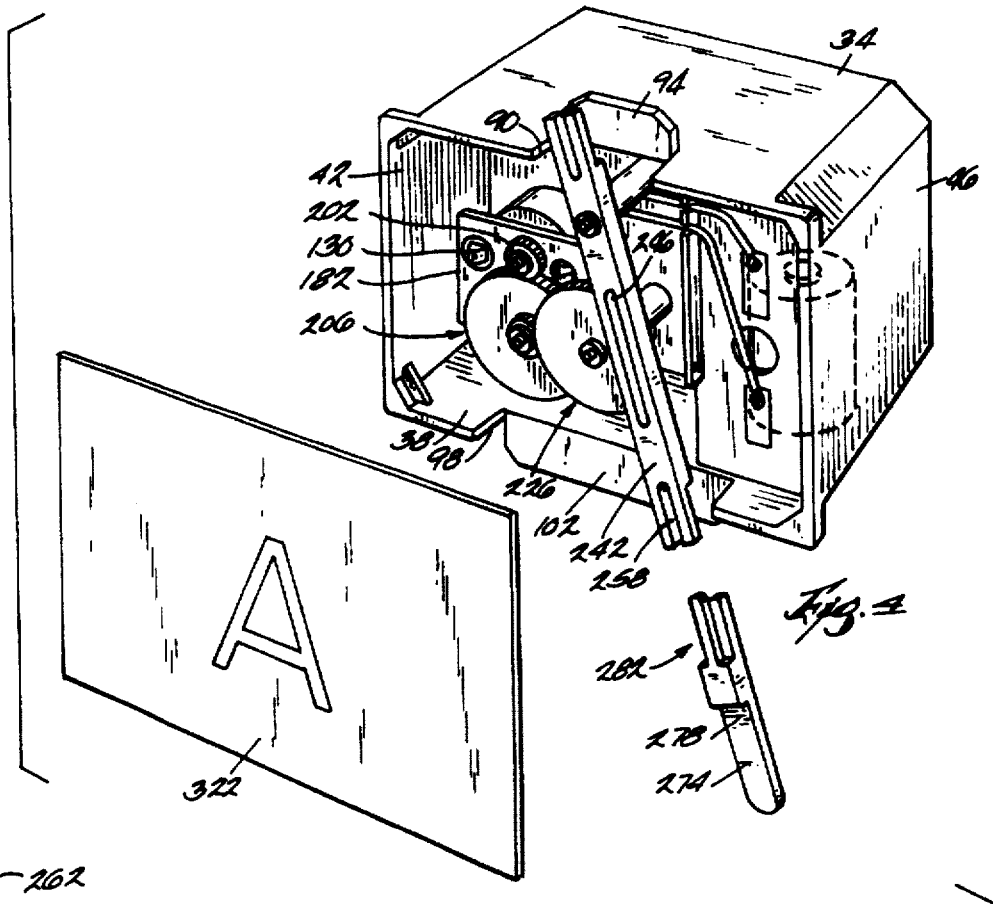
FIG. 4 is an exploded perspective view of the apparatus with the main advertising card removed from the housing.
Figure 6:
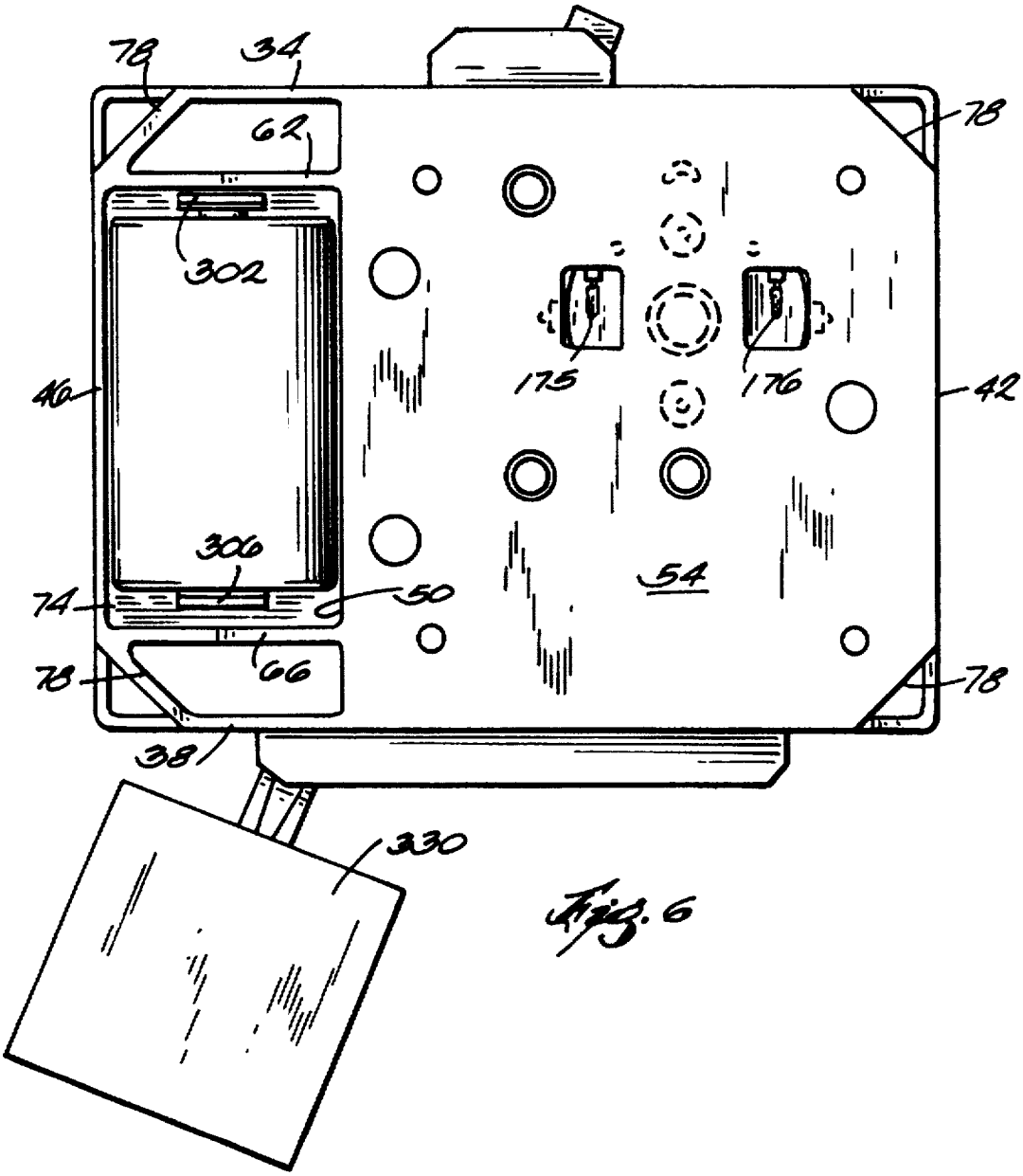
FIG. 6 is a rear elevational view of the apparatus.
Figure 7:
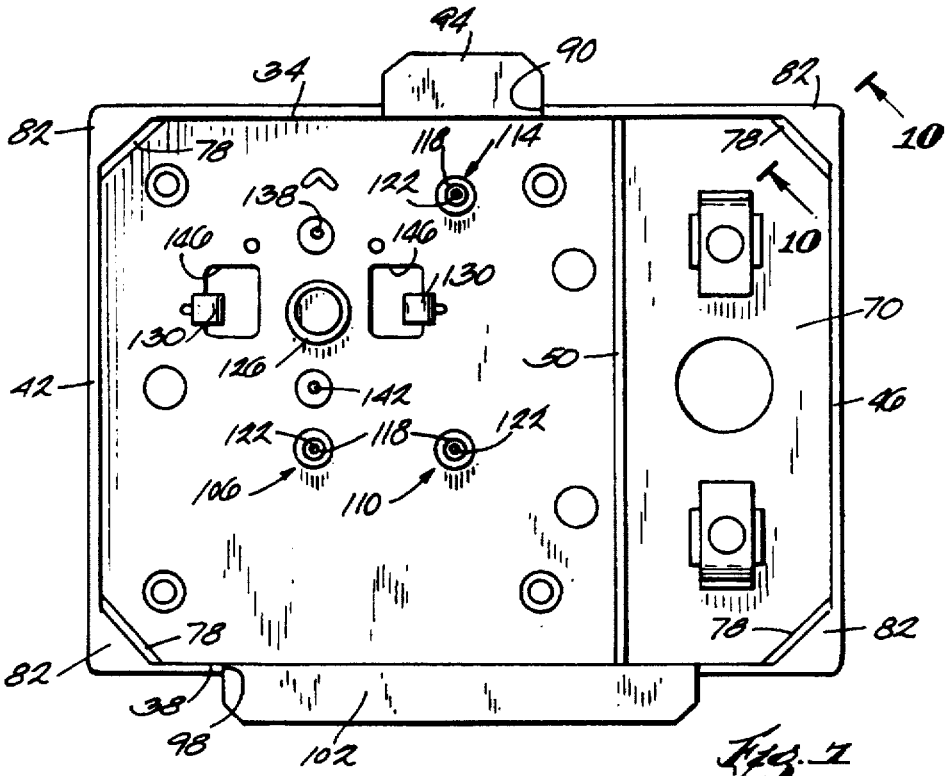
FIG. 7 is a front elevational view of the housing.
Figure 10:
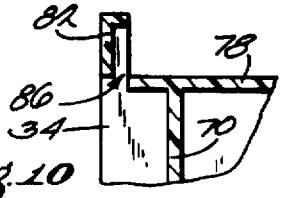
FIG. 10 is a view taken along line 10—10 of FIG. 7.

The four corners defined by the top and bottom walls 34 and 38 and the end walls 42 and 46 are beveled, as shown in FIG. 6, to provide four corner walls 78. A projection 82 extends outwardly from the front of each corner so as to define a slot 86 (see FIG. 10) between each projection 82 and the associated corner wall 78. The front edge of the top wall 34 has therein (see FIGS. 4 and 7) a recess or cutout 90 defined in part by an upwardly extending tab 94. The front edge of the bottom wall 38 has therein a recess or cutout 98 defined in part by a downwardly extending tab 102. As shown in FIG. 7, the lower recess 102 is significantly longer than the upper recess 94.

Figure 5:
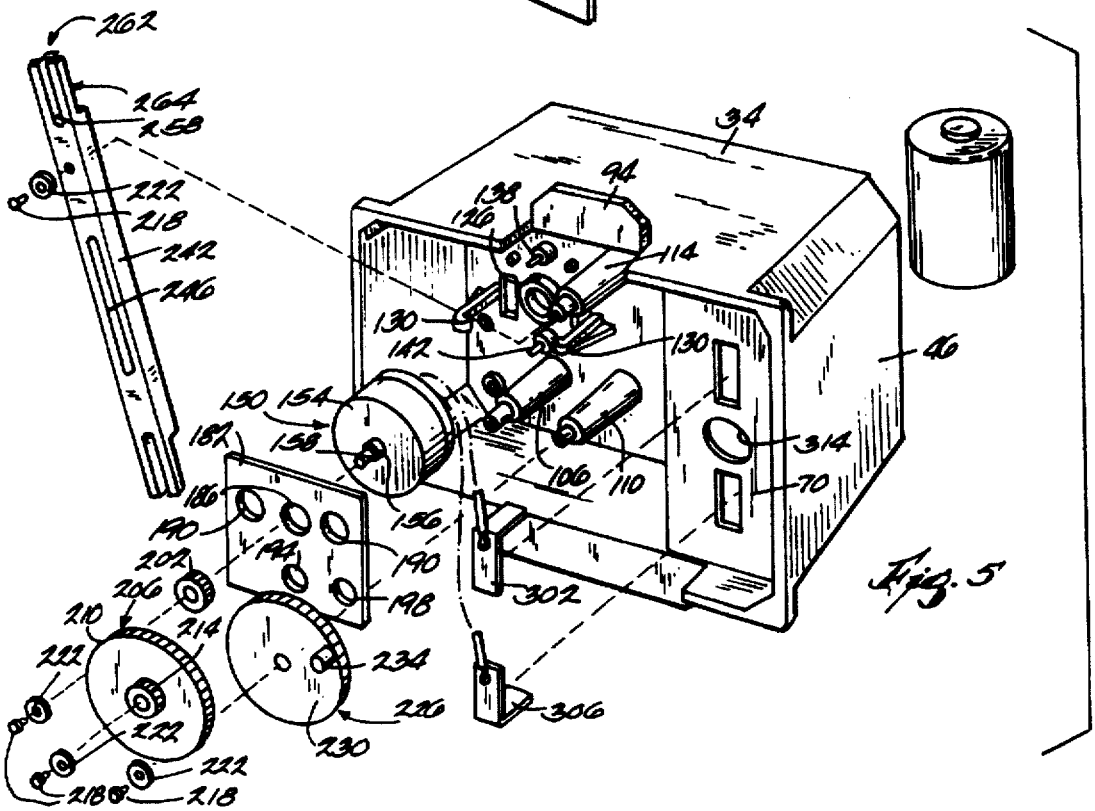
FIG. 5 is an exploded perspective view of the apparatus with the internal components removed from the housing.
Figure 8:
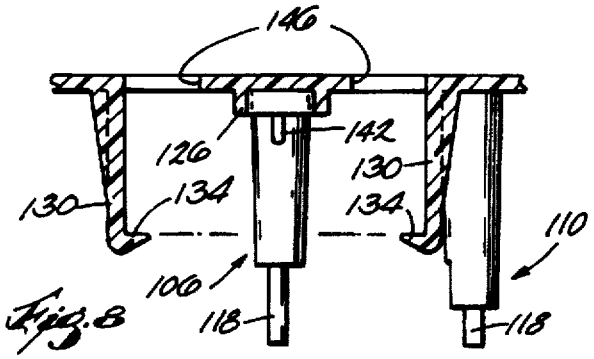
FIG. 8 is a view taken along line 8—8 in FIG. 2.

The back wall 54 has thereon (see FIG. 7) a reduction gear mounting post 106, an output gear mounting post 110, and a pivot arm mounting post 114. All three of the posts extend forwardly from the back wall 54 in perpendicular relation thereto and into the main chamber 58. The forward end of each of the posts 106, 110 and 114 includes a reduced diameter portion 118 and a central aperture 122. The back wall 54 also has thereon (see FIGS. 5, 7 and 8) a forwardly extending, circular motor seat 126, and forwardly extending motor retainers 130 on opposite sides of the motor seat 126. The retainers 130 are flexible, and the outer end of each retainer has thereon (see FIG. 8) an inwardly extending tab 134. The tabs 134 are angled so that insertion of the motor described below deflects the retainers 130 outwardly until the motor snaps in beneath the tabs 134. The back wall 54 also has thereon (see FIGS. 5 and 7) an upper motor mounting pin 138 above the motor seat 126 and a lower mounting pin 142 below the motor seat 126. The pins 138 and 142 extend forwardly from the back wall 54. The back wall 54 has therein (see FIGS. 7 and 8) an opening 146 behind each of the tabs 134. The openings 146 facilitate injection molding of the tabs 134. The back wall 54 is perpendicular to the die axis 30, so that all of the housing elements extending forwardly from the back wall 54 can be formed by the two die parts 22 and 26.

The display 10 also comprises (see FIGS. 3 and 5) a DC motor 150. Except as described below, the motor 150 is conventional and need not be described in greater detail. The motor 150 is a permanent magnet, brush type motor. The motor 150 includes a cylindrical motor housing 154. A motor hub 156 and an output shaft 158 extend from the front of the motor housing 154, and an end cap 162 (see FIG. 3) closes the rear of the motor housing 154. The end cap 162 has thereon a rearwardly extending, cylindrical projection 166 and has therein mounting apertures 170 and 174 on opposite sides of the projection 166. Terminals 175 and 176 (see FIG. 6) extend from the end cap 162. The motor 150 snaps between the retainers 130 as described above, so that the projection 166 extends into the motor seat 126 and so that the mounting pins 138 and 142 extend into the mounting apertures 170 and 174, respectively. The inter-engagement of the projection 166 in the seat 126 and of the pins 138 and 142 in the apertures 170 and 174 fixes the motor 150 rotationally and perpendicular to the axis relative to the housing 14. The back wall 54 and the retainer tabs 134 fix the motor 150 axially relative to the housing 14. If desired, the motor 150 can be provided with slots (not shown) receiving the tabs 134. Thus, once the motor 150 is snapped into the housing 14, it is completely fixed relative to the housing 14, with the motor output shaft 158 extending along a motor axis 178 (see FIG. 3) perpendicular to the back wall 54.

In the illustrated construction, the display 10 also comprises (see FIGS. 4 and 5) a retainer plate 182. The retainer plate 182 has therein (see FIG. 5) an aperture 186 snugly receiving the motor hub 156, an aperture 190 snugly receiving one of the retainers 130, an aperture 190 snugly receiving the other of the retainers 130, an aperture 194 snugly receiving the reduction gear post 106, and an aperture 198 snugly receiving the output gear post 110. The purpose of the retainer plate 182 is to further secure the motor output shaft 158 in proper position relative to the posts 106, 110 and 114. It should be understood that the retainer plate 182 can be omitted in alternative embodiments of the invention. The retainer plate 182 is preferably fixed to the motor housing 154 by suitable means such as two-sided tape (not shown).

The display 10 also comprises (see FIGS. 3–5) a motor pinion 202 mounted on the motor output shaft 158 for rotation therewith. The motor pinion 202 slides on to the output shaft 158 after the retainer plate 182 is positioned. Preferably, the aperture 186 in the retainer plate 182 has an inner diameter larger than the outer diameter of the motor pinion 202.

A reduction gear assembly 206 (see FIGS. 2–5) is rotatably mounted on the reduced diameter portion of the reduction gear post 106. The reduction gear assembly 206 is preferably made of injection molded plastic. The reduction gear assembly 206 includes (see FIGS. 3 and 5) a large diameter secondary gear 210 and a small diameter pinion 214. The teeth of the secondary gear 210 mesh with the motor pinion 202 so that rotation of the motor pinion 202 causes rotation of the reduction gear assembly 206. A retaining pin 218 is inserted into the central aperture of the reduction gear post 106, with a washer 222 between the head of the pin 218 and the reduction gear assembly 206, to hold the reduction gear assembly 206 on the end of the reduction gear post 106.

An output gear assembly 226 (see FIGS. 2, 4 and 5) is rotatably mounted on the reduced diameter portion of the output gear post 110. A retaining pin 218 is inserted into the central aperture of the output gear post 110, with a washer 222 between the head of the pin 218 and the output gear assembly 226, to hold the output gear assembly 226 on the end of the post 110. The output gear assembly 226 includes (see FIGS. 2 and 5) a large diameter gear 230 meshing with the pinion 214 so that rotation of the reduction gear assembly 206 causes rotation of the output gear assembly 226. Because of the relative diameters of the motor pinion 202, the secondary gear 210 of the reduction gear assembly 206, the pinion 214 of the reduction gear assembly 206, and the gear 230 of the output gear assembly 226, the output gear assembly 226 rotates at a substantially slower speed than the motor output shaft 158. The output gear assembly 226 also includes a cylindrical pin or projection 234 extending forwardly from the gear 230 adjacent the teeth thereof. The projection 234 has therein a central aperture 238 (see FIG. 2).

The display 10 also comprises (see FIGS. 2, 4 and 5) a pivot arm 242 pivotally mounted on the reduced diameter portion of the pivot arm post 114. The pivot arm 242 has therein a longitudinal slot 246 receiving the projection 234 of the output gear assembly 226 so that the projection 234 slides reciprocally in the slot 246. A retaining pin 218 (see FIG. 5) is inserted into the central aperture of the projection 234, with a washer 222 between the head of the pin 218 and the projection 234, to secure the projection 234 in the slot 246 while allowing the projection 234 to slide in the slot 246. Rotation of the output gear assembly 226 and movement of the projection 234 in the slot 246 causes pendulum type movement of the pivot arm 242, as is apparent from FIG. 2. The upper end of the pivot arm 242 extends through the recess 90 in the top wall 34, and the lower end of the pivot arm 242 extends through the recess 98 in the bottom wall 38. At each end of the pivot arm 242, referring to FIGS. 2 and 5, the front surface has therein a longitudinal slot 258 and the back surface has therein spaced longitudinal slots 262 and 264, with the inner end of each of the slots 262 and 264 having (see FIG. 2) an inward indentation 266.

The display 10 also comprises (see FIGS. 2 and 4) upper and lower pivot arm extensions 270 and 274, respectively. The extensions 270 and 274 shown in the drawings are substantially identical and only the upper extension 270 will be described in detail. Common elements have been given the same reference numerals. The extension 270 is preferably made of injection molded plastic. The upper extension 270 includes an upper material supporting portion 278 and a lower attachment portion 282. The attachment portion 282 includes (see FIG. 2) a longitudinal projection 286 slidable into the slot 258, a longitudinal projection 290 slidable into the slot 262, and a longitudinal projection 294 slidable into the recess 264. The ends of the projections 290 and 294 have inwardly extending tabs 298 which snap into the associated indentations 266 to releaseably secure the extension 270 to the pivot arm 242. While the extensions 270 and 274 shown in the drawings are straight, the extensions 270 and 274 can be L-shaped, U-shaped, curved, or any combination thereof and the extensions can be used separately or in combination with one another as required by the particular application.

The display 10 also comprises (see FIG. 2) battery contacts 302 and 306 fixed to the wall 70 by suitable means such as a snap fit or plastic weld. The contacts 302 and 306 extend into the battery space 74 for electrical contact with the opposite ends of a conventional size D dry cell battery 310 located in the battery space 74. An opening 314 in the front battery space wall 70 allows the insertion of a finger to push the battery 310 out of the battery space 74 when desired. Wires 318 extend between the battery contacts and the motor contacts to provide electrical power to the motor 150.

The display 10 also comprises (see FIGS. 1–4) a rectangular display card 322 which has thereon advertising material and which is removably mounted on the housing 14. More particularly, the corners of the card 322 are removably inserted in the slots 86 (see FIG. 3) so that the card 322 is held in position relative to the housing 14 and closes the front of the housing 14. An upper display card 326 (see FIGS. 1 and 2) has thereon advertising material and is mounted on the upper extension 270, and a lower display card 330 has thereon advertising material and is mounted on the lower extension 274. Any suitable means can be used to secure the cards 326 and 330 on the extensions. The upper and lower display cards 326 and 330 move back and forth in opposite directions with the opposite ends of the pivot arm 242. The display 10 is thus a dual pendulum display along with a fixed or static display (the card 322).

The housing 14 maintains correct alignment of the motor 150, the reduction gear assembly 206, the output gear assembly 226 and the pivot arm 242 and also holds the battery 310. Holes in the back wall 54 of the housing 14 allow various methods of mounting the display 10, such as slot wall, price rail, peg board, metal bracket with eyelets, or suction cups. The housing 14 can also be used "flat" to move advertising material horizontally or vertically.

The display 10 is manufactured by separately injection molding the housing 14, the motor pinion 202, the reduction gear assembly 206, the output gear assembly 226, the pivot arm 242, and the upper and lower extensions 270 and 274. The motor 150 is snapped into position, and the retainer plate 182, the motor pinion 202, the reduction gear assembly 206, the output gear assembly 226 and the pivot arm 242 are then mounted on the housing 14 in the stated order. The contacts 302 and 306 are also fixed to the housing 14 and connected to the motor 150 by the wires 318. The display 10 is preferably pre-assembled and shipped in this condition, so that the customer need only snap the upper and lower extensions onto the pivot arm 242, attach the display cards, and install the battery 310. The battery 310 can be easily replaced when necessary, and the display cards can be easily changed to provide new advertising material.

Various features of the invention are set forth in the following claims.

The invention claimed is:

1. A dual pendulum display apparatus comprising:

a housing, a motor which is fixed to said housing and which has a motor output shaft, an output gear which is driven by said output shaft, which is mounted on said housing for rotation relative thereto about an output gear axis, and which has thereon a projection spaced from said output gear axis, a pivot arm mounted on said housing for pivotal movement relative thereto about a pivot arm axis spaced from said output gear axis, said pivot arm having therein a longitudinal slot receiving said projection for reciprocal sliding movement of said projection in said slot, such that rotation of said output gear and movement of said projection in said slot causes pendulum type motion of said pivot arm, said pivot arm having opposite first and second ends spaced from said pivot arm axis and extending outside of said housing, first advertising material mounted on said first end of said pivot arm, and second advertising material mounted on said second end of said pivot arm, such that said first advertising material and said second advertising material move back and forth in opposite directions in response to pendulum type movement of said pivot arm.

2. Apparatus as set forth in claim 1 wherein said motor output shaft is rotatable about a motor axis, and wherein said output gear axis is spaced from said motor axis.

3. Apparatus as set forth in claim 2 wherein said display also comprises a motor pinion mounted on said motor output shaft for rotation therewith, and wherein said output gear is driven by said motor pinion.

4. Apparatus as set forth in claim 3 and further comprising a reduction gear assembly which is mounted on said housing for rotation relative thereto about a reduction gear axis spaced from said motor axis and from said output gear axis, and which includes a large diameter secondary gear directly driven by said motor pinion and a small diameter pinion directly driving said output gear.

5. Apparatus as set forth in claim 4 wherein said housing includes a seat for said motor.

6. Apparatus as set forth in claim 5 wherein said housing also includes pins for preventing rotation of said motor relative to said housing.

7. Apparatus as set forth in claim 6 wherein said housing also includes retainers integral with the housing for preventing axial movement of said motor relative to said housing, said retainers each having an end including a tab engaging said motor.

8. Apparatus as set forth in claim 7 wherein said housing also includes a reduction gear mounting post on which said reduction gear assembly is mounted, an output gear mounting post on which said output gear is mounted, and a pivot arm mounting post on which said pivot arm is mounted.

9. Apparatus as set forth in claim 8 wherein said housing is injection molded.

10. Apparatus as set forth in claim 1 wherein said display also comprises first and second pivot arm extensions which are respectively connectable to said first and second ends of said pivot arm and which respectively support said first and second advertising materials.

11. Apparatus as set forth in claim 10 wherein each of said extensions includes an outer portion supporting the associated advertising material and an inner portion attachable to said pivot arm.

12. Apparatus as set forth in claim 4 and further comprising third advertising material fixedly mounted on said housing.

13. Apparatus as set forth in claim 12 wherein said third advertising material closes said housing so as to enclose said motor, said reduction gear assembly, and said output gear, and so as to partially enclose said pivot arm.

14. Apparatus as set forth in claim 1 wherein said housing defines a battery space, and wherein said apparatus further comprises a battery contained in said battery space and connected to said motor.

15. A dual pendulum display apparatus comprising an injection molded housing defining a battery space, a motor which is fixed to said housing and which has a motor output shaft rotatable about a motor axis, a battery contained in said battery space and connected to said motor, a motor pinion mounted on said motor output shaft for rotation therewith, a reduction gear assembly which is mounted on said housing for rotation relative thereto about a reduction gear axis spaced from said motor axis, which includes a large diameter secondary gear driven by said motor pinion, and which includes a small diameter pinion, an output gear which is driven by said small diameter pinion, which is mounted on said housing for rotation relative thereto about an output gear axis spaced from said motor axis and from said reduction gear axis, and which has thereon a projection spaced from said output gear axis, a pivot arm mounted on said housing for pivotal movement relative thereto about a pivot arm axis spaced from said output gear axis, said pivot arm having therein a longitudinal slot receiving said projection for reciprocal sliding movement of said projection in said slot, such that rotation of said output gear and movement of said projection in said slot causes pendulum type motion of said pivot arm, said pivot arm having opposite first and second ends spaced from said pivot arm axis and extending outside of said housing, said housing including a seat for said motor, pins for preventing rotation of said motor relative to said housing, retainers for preventing axial movement of said motor relative to said housing, a reduction gear mounting post on which said reduction gear assembly is mounted, an output gear mounting post on which said output gear is mounted, and a pivot arm mounting post on which said pivot arm is mounted, first and second pivot arm extensions respectively removably connected to said first and second ends of said pivot arm, each of said extensions including an outer portion and an inner portion attached to said pivot arm, first advertising material mounted on said outer portion of said first extension, second advertising material mounted on said outer portion of said second extension, and third advertising material fixedly mounted on said housing, said third advertising material closing said housing so as to enclose said motor, said reduction gear assembly, and said output gear, and so as to partially enclose said pivot arm, such that said first advertising material and said second advertising material move back and forth in opposite directions in response to pendulum type movement of said pivot arm.

* * * * *